United States Patent [19]

Ricks, Sr.

[11] Patent Number: 4,505,333

[45] Date of Patent: Mar. 19, 1985

[54] METHODS OF AND MEANS FOR LOW VOLUME WELLHEAD COMPRESSION HYDROCARBON GAS

[76] Inventor: Tom E. Ricks, Sr., 4306 Durango, Odessa, Tex. 79762

[21] Appl. No.: 298,882

[22] Filed: Sep. 2, 1981

[51] Int. Cl.[3] ..... E21B 43/00; E21B 43/34

[52] U.S. Cl. ..... 166/267; 166/53; 166/369; 417/17; 417/243

[58] Field of Search ..... 417/17, 44, 265, 243; 166/267, 266, 53, 369, 65 R

[56] References Cited

U.S. PATENT DOCUMENTS

| | | | |
|---|---|---|---|
| 1,510,169 | 9/1924 | Aikman | 417/17 X |
| 2,151,825 | 3/1939 | Aikman | 417/265 X |
| 2,309,075 | 1/1943 | Hill | 166/266 |
| 2,312,728 | 3/1943 | O'Hagan et al. | 417/44 X |
| 2,355,167 | 8/1944 | Keith | 166/267 X |
| 2,588,296 | 3/1952 | Russell, Jr. | 166/267 X |
| 2,617,484 | 11/1952 | Swearingen | 166/266 X |
| 2,673,028 | 3/1954 | Cornelius et al. | 417/265 |
| 3,216,648 | 11/1965 | Ford | 417/265 X |
| 3,526,276 | 9/1970 | Bennett et al. | 166/267 X |
| 4,213,476 | 7/1980 | Bresie et al. | 166/369 X |

*Primary Examiner*—Stephen J. Novosad

*Attorney, Agent, or Firm*—Guy E. Matthews

[57] ABSTRACT

Methods and means for economically compressing low volume, low pressure natural gas at the wellhead are provided. The means include an electrically operated, self starting compressor responsive to a low pressure inlet shut-off switch and a high pressure discharge shut-off switch. The means may also include a scrubber for separating liquid and condensate from the gas and means for automatically transporting such to a remote liquid storage tank. The compressor itself is an air compressor modified by the provision of natural gas crankcase purging and venting, suction port oil injection, and increase lubrication capacity.

9 Claims, 4 Drawing Figures fig.1
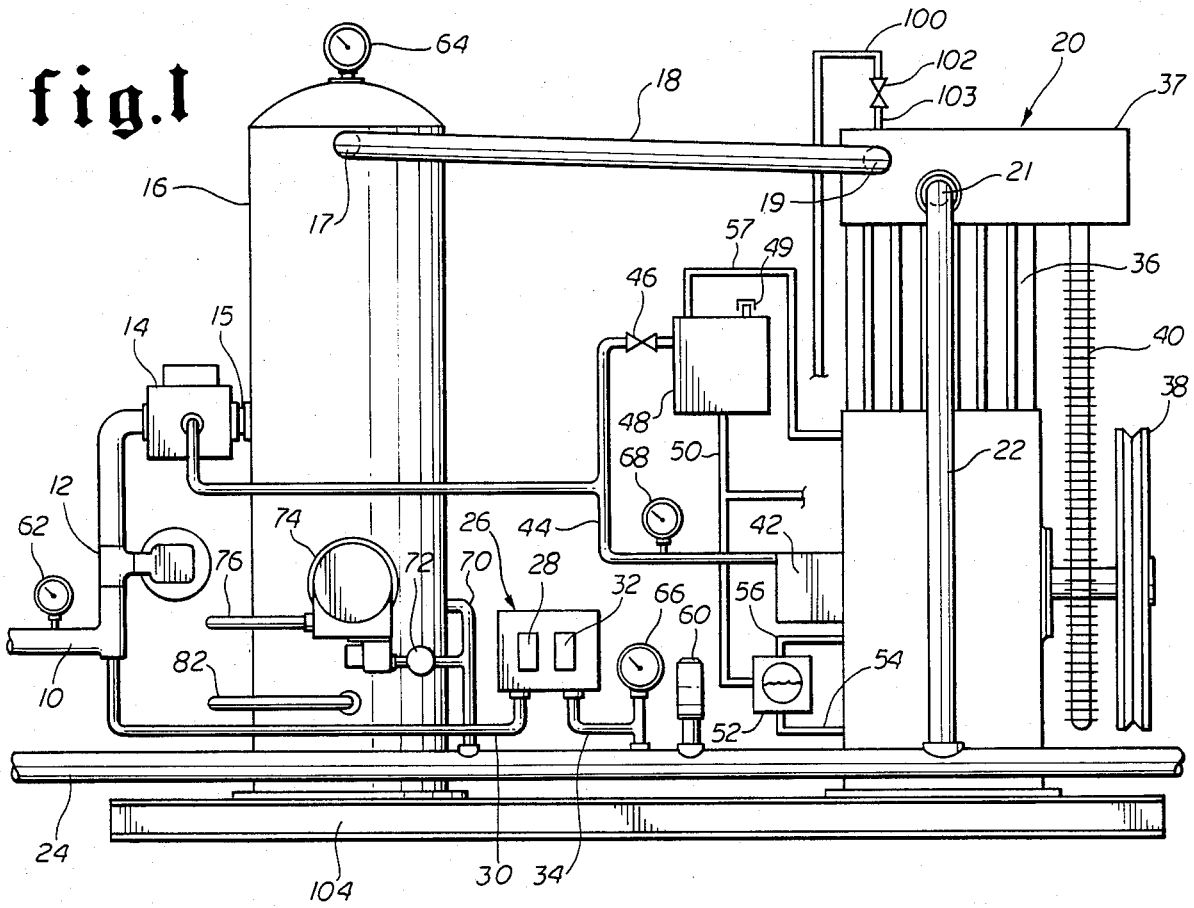
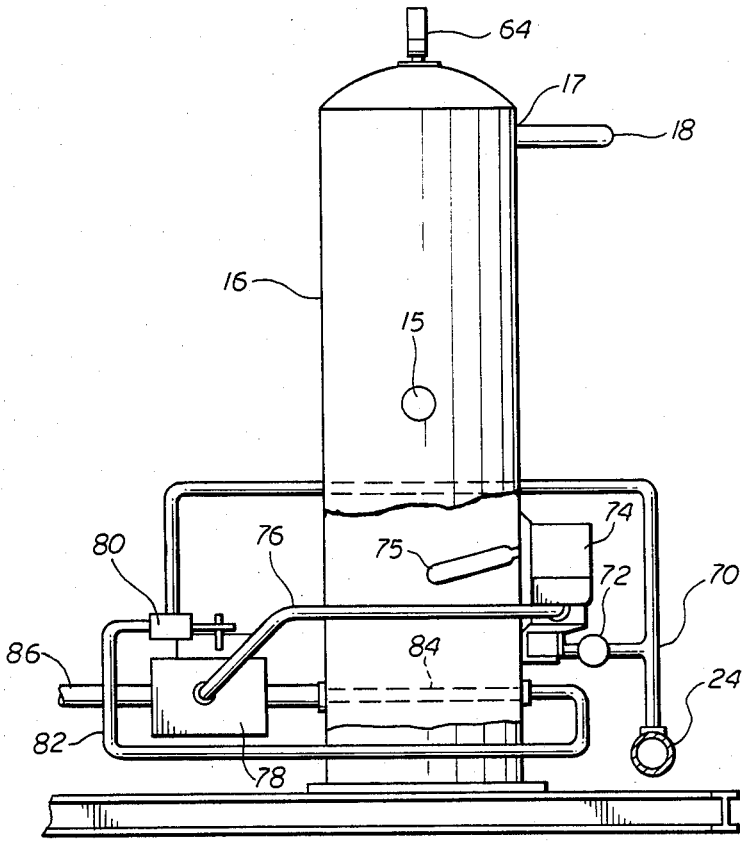
fig.2

METHODS OF AND MEANS FOR LOW VOLUME WELLHEAD COMPRESSION HYDROCARBON GAS

BACKGROUND OF THE INVENTION

This invention relates to methods and means for low volume production of natural gas from hydrocarbon wells, and more specifically relates to methods and means for economical wellhead compression of said gas.

Domestic oil and gas supplies have been unable to satisfy domestic demand for these products in recent years. Prices offered for these products have risen dramatically. Even so, low pressure natural gas produced from wells in the range of 20,000 to 60,000 cubic feet per day is often vented to the atmosphere for lack of an economical means to compress such low volumes of low pressure gas for entry into a gas collection pipeline system. In those cases where such gas is not vented, units currently in use are often powered by natural gas produced from the well, often consuming as much as one half of the daily natural gas production of the well to compress the other half. The loss of this gas used to run the compressor, together with the cost of the compressor's purchase or rental, has often made such gas collection uneconomical.

Further, conventional natural gas powered compressors lack the capability of restarting themselves automatically. Therefore, when flow into the gas collection pipeline is temporarily interrupted and the compressor is thereby shut down, as is common for maintenance operations such as pigging the gas collection pipelines, the gas powered compressor unit remains idle. Production of natural gas is lost until the unit is manually restarted, possibly days later.

Therefore it is an object of this invention to provide methods and means for economically compressing low volumes of low pressure natural gas at the wellhead for entry into a gas collection pipeline system.

It is a further object of this invention to provide electrically operated means to compress low volume, low pressure natural gas without objectionable rise in the temperature of the gas necessitating use of expensive intercoolers or resulting in the rejection of the gas by the gas collection system.

It is a further object to this invention to provide methods and means for compressing low volume, low pressure natural gas at the wellhead which are automatically self starting when conditions are suitable for operation.

SUMMARY OF THE INVENTION

Methods and means for economically compressing low volume, low pressure natural gas at the wellhead are provided. The means include an electrically operated, self starting compressor responsive to a low pressure inlet shut-off switch and a high pressure discharge shut-off switch. The means may also include a scrubber for separating liquid and condensate from the gas and means for automatically transporting such to a remote liquid storage tank. The compressor itself is an air compressor modified by the provision of natural gas crankcase purging and venting, suction port oil injection, and increased lubrication capacity.

BRIEF DESCRIPTION OF THE DRAWINGS

Other objects and advantages of the invention will become apparent upon reading the following detailed description and upon reference to the drawings, in which:

FIG. 1 is a side view of the skid mounted gas compressor means of the present invention.

FIG. 2 is a partially broken away left side view of the skid mounted gas compressor system of the present invention, showing particularly the scrubbing means.

Figure 3:
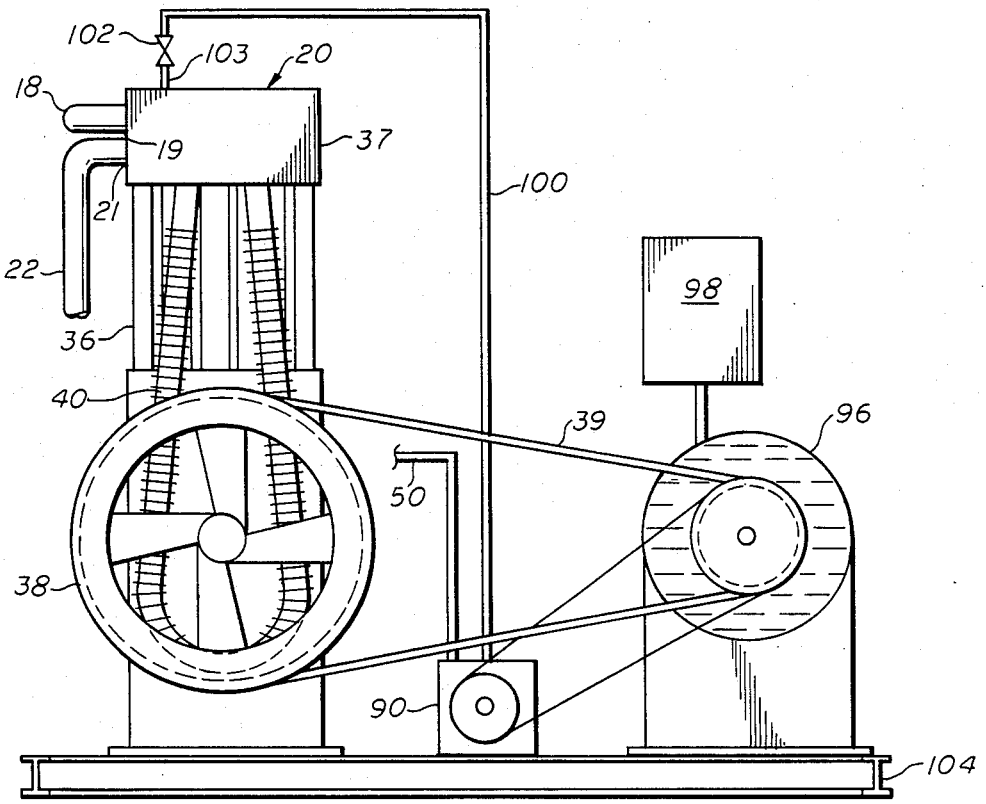
FIG. 3 is a right side view of the skid mounted gas compressor means of the present invention.

While the invention will be described in connection with a preferred embodiment and procedure, it will be understood that it is not intended to limit the invention to that embodiment or procedure. On the contrary, it is intended to cover all alternatives, modifications and equivalents as may be included within the spirit and scope of the invention as defined by the appended claims.

DETAILED DESCRIPTION OF THE INVENTION

Turning first to FIG. 1, there is seen an inlet manifold 10, connected to a hydrocarbon well, not shown. Low pressure fluid, including natural gas, entering said inlet manifold 10 continues through a high pressure regulator 12, which prevents the pressure downstream of the regulator 12 from exceeding a predetermined limit. Fluid then passes through a motor valve 14 and a port 15 into a scrubber vessel 16, where liquid and condensate are separated by gravity from the natural gas in the fluid. The low pressure natural gas exits the scrubber vessel 16 at a port 17 through a passage 18 and enters a compressor 20 through an inlet port 19. After being compressed therein, the natural gas, now high pressure, exits the compressor 20 through a discharge port 21 and a passage 22 into a discharge manifold 24, from whence it passes to a gas collection pipeline, not shown.

Operation of the compressor is controlled by a switch panel 26, which includes a high pressure switch 32 and a low pressure switch 28, connected in series. The high pressure switch 32 is connected to the discharge manifold 24 by a passage 34. The high pressure switch 32 turns "off" when the pressure in the discharge manifold 24 reaches a first predetermined pressure, indicating that the gas collection pipeline is momentarily not accepting gas. When the gas collection pipeline once again will accept gas, pressure in the discharge manifold 24 dissipates into the gas collection pipeline. When the pressure at the high pressure switch 32 drops below a second predetermined pressure, the high pressure switch 32 resets to the "on" position.

Similarly, the low pressure switch 28, which is connected to the inlet manifold 10 by passage 30, turns off when the pressure in the inlet manifold 10 drops below a third predetermined pressure, indicating that insufficient natural gas is available from the wellhead. As more gas becomes available, pressure in the inlet manifold 10 builds up until it reaches a fourth predetermined pressure, at which the low pressure switch 28 resets to the "on" position. Use of the low pressure switch 28 with an automatically restarting compressor permits the compressor to cycle on and off at wells where it has the capacity to compress more gas than the well can provide. Additionally, the switch can prevent the compressor 20 from drawing the wellhead gas pressure below that needed to operate wellhead oilwater separators or similar devices upstream of the compressor 20.

The compressor 20 will operate only when both the high pressure switch 32 and the low pressure switch 28 are in the "on" position. If either resets to the "off" position, the compressor ceases to operate. When both switches are reset again to the "on" position, the compressor 20 automatically starts.

Figure 4:
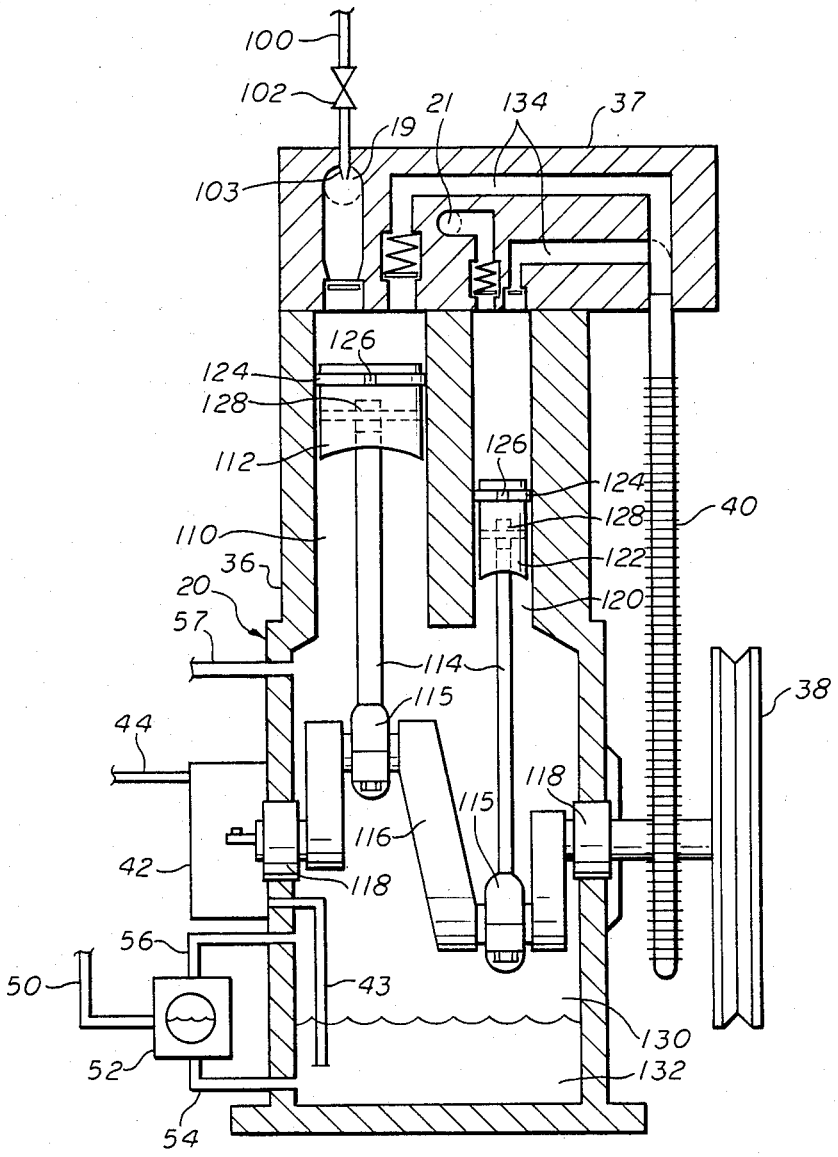
FIG. 4 is a section of the compressor.

As shown in FIG. 4, the compressor 20 is a reciprocating, two stage compressor converted from air compressor use and includes a compressor body 36 and a head 37. The body 36 contains two cylinders, a larger diameter cylinder 110 containing a piston 112 and a smaller diameter cylinder 120 containing a piston 122. Each piston is connected to a crankshaft 116 by a connecting rod 114. The crankshaft 116 is rotated by a belt 39 acting on a pulley 38. The crankshaft rides in roller main bearings 118. The connecting rods 114 have sleeve bearings 115 at the crankshaft ends and roller bearings 128 at the piston ends, replacing the sleeve bearings normally supplied at the piston ends. The pistons 112 and 122 are fitted with piston rings 124, each having a gap 126 which is widened to increase the blow by of gas from above the piston, thereby continuously purging a crankcase 130 through a vent tube 57. A lubricating oil pump 42 is driven from the crankshaft 116 and has an oil pick-up tube 43 extending into a sump 132 in the crankcase 130 containing lubricating oil.

Gas enters the compressor through the inlet port 19 and flows into the large diameter cylinder 110 above the large diameter piston 112, where it is compressed. It then flows through passages 134 in the cylinder head 37 and through an interstage cooler 40 into the small diameter cylinder 120 above the small diameter piston 122, where it is further compressed before exiting from the compressor through discharge port 21.

Lubricating oil from the lubricating oil pump 42 lubricates the internal moving parts and bearings of the compressor 20. The lubricating oil also passes through a passage 44 and a metering valve 46 into an external, nonpressurized lubricating oil tank 48, which is vented to the atmosphere by a vent 49. The vent passage 57 is also connected to the tank 48. The lubricating oil within the tank 48 may flow through a passage 50 and a passage 54 into the sump 132 of the compressor 20 as controlled by a float level control valve 52, which prevents the level of lubricating oil within the sump from falling below a predetermined minimum. The float level control valve 52 is vented to the compressor crankcase by a passage 56.

The discharge manifold 24 is provided with a safety valve 60. A gauge 62 indicates the pressure in the inlet manifold 10. A gauge 64 indicates the pressure in the scrubber vessel 16. A gauge 66 indicates the pressure in the discharge manifold 24, while a gauge 68 indicates the lubricating oil pressure.

As is better shown in FIG. 2, the scrubber vessel 16 is provided with an automatic dump system to move the accumulated liquid and condensate to a remote liquid storage vessel, not shown. A passage 70 provides high pressure gas from the discharge manifold 24 to a pressure regulator 72, which in turn provides low pressure gas to a liquid level float control valve 74 having a float 75. When the level of the liquid and condensate within the scrubber tank 16 is such that the float 75 is in the down position shown, the liquid level float control valve 74 is closed. When the level of the liquid and condensate within the scrubber tank 16 is such that the float 75 is in the up position, the liquid level float control valve 74 opens, permitting the gas to pass through a passage 76 and open a pressure operated valve 78. The valve 78 is adapted so that its opening also opens a valve 80, which permits high pressure gas from the passage 70 to pass through a passage 82 into a jet tube 84 within the lower portion of the scrubber vessel 16. As the high pressure gas flows through the jet tube 84, it sucks liquid and condensate into the jet tube 84 and carries them from the scrubber tank 16 through the motor valve 78 and a passage 86 to the remote storage tank, not shown, where the liquid and condensate are stored and the gas is vented. When enough of the liquid and condensate has been removed from the scrubber tank 16, the float 75 drops, closing the liquid level float control valve 74, which removes the pressure from the motor valve 78, allowing it and valve 80 to close, halting the dumping operation.

As is best shown in FIG. 3, a high pressure metering lubricating oil pump 90 receives lubricating oil from the compressor lubricating oil pump 42 through the passage 50. The high pressure metering lubricating oil pump 90 is driven by a belt 94 passing over a pulley 92. The lubricating oil is pumped at a preset rate through a passage 100, a check valve 102 and a nozzle 103, which introduces the oil as a fine mist into the inlet port 19 of the compressor 20. Both the compressor 20 and the high pressure lubricating oil pump 90 are driven through the belts 39 and 94 by an electric motor 96. A magnetic starter 98 is connected to the electric motor 96 and to the switch panel 26. The entire system described is mounted upon a skid 104.

In operation, the switch panel 26 determines whether the electric motor 96 is operating at any given moment. Operation of the electric motor 96 requires that both the high pressure switch 32 and the low pressure switch 28 be in the "on" position. The high pressure switch 32 will reset to the "off" position when the pressure in the discharge manifold 24 rises above a first predetermined pressure. The high pressure switch 32 will not reset to the "on" position until the discharge manifold pressure drops below a second predetermined pressure which is less than the first predetermined pressure. The difference between these two pressures prevents the motor from cycling on and off too rapidly. The low pressure switch 28 operates similarly, resetting itself to the "off" position when the pressure in the inlet manifold 10 drops below a third predetermined pressure, then resetting to the "on" position when the pressure rises above a fourth predetermined pressure which is greater than the third predetermined pressure. When one of the two switches 28 and 32 is in the "on" position and the other resets to the "on" position, the magnetic starter 98 acts to start the electric motor 96, actuating the compressor 20.

When the compressor 20 is not operating, the compressor lubricating oil pump 42 produces no pressure and therefore the motor valve 14, which is sensitive to this pressure, remains shut. Therefore fluid from the wellhead entering the system at the inlet manifold 10 may not pass beyond the motor valve 14. When the switch panel 26 starts the electric motor 96 and therefore the compressor 20, the motor valve 14 is opened by pressure from the lubricating oil pump 42 acting through passage 44, and fluid from the wellhead passages through the port 15 into the scrubber vessel 16. The high pressure regulator 12 prevents the pressure in the scrubber vessel 16 from exceeding some predetermined limit, therefore permitting the use of lower strength components for the scrubber vessel 16, if desired. The liquid and condensate settle to the bottom of the scrubber vessel 16, where they accumulate. The gas passes out through the port 17 and the passage 18 into the compressor 20 at the inlet port 19. A fine mist of lubricating oil is injected at a controlled rate into the gas through the nozzle 103 at the intake port 19. Inside the compressor 20, the low pressure gas first enters the large diameter, low stage cylinder 110 where it is compressed by the piston 112. The gas then flows through the interstage cooler 40 and into the small diameter, high stage cylinder 120, where it is further compressed by the piston 122 into a high pressure gas, and discharged from the compressor through the discharge port 21, the passage 22 and the discharge manifold 24, from which it enters the gas collection pipeline.

Operation of the compressor 20 also operates the lubricating oil pump 42, typically driven from the compressor crankshaft. Lubricating oil from the pump 42 lubricates the internal moving parts and bearings of the compressor 20, actuates the motor valve 14 through the passage 44, and is bled by the metering valve 46 into the nonpressurized lubricating oil storage tank 48. The passage 50 conveys the lubricating oil from the storage tank 48 through a float level control valve 52 and a passage 54 into the compressor sump and maintains the lubricating oil level therein through the action of the float level control valve 52. Small amounts of the compressed gas blow by the widened piston ring gaps 126 of the compressor pistons 110 and 120 and continuously purge the crankcase 130 of the compressor 20 through the vent passage 57. Lubricating oil from the storage tank 48 also flows through the passage 50 to the high pressure metering lubricating oil pump 90, from which it flows at a predetermined rate through the passage 100, the check valve 102 and the injector 103 into the compressor intake port 19 as a fine mist. When the level of the accumulated liquid and condensate in scrubber vessel 16 is sufficient to raise the float 75 of the float control valve 74, the liquid and condensate is moved to a remote liquid storage tank. Raising the float 75 opens the float control valve 74 which permits high pressure gas from the discharge manifold 24 to flow through the pressure regulator 72 and the float valve 74 and open the motor valve 78 and the valve 80. Opening valve 80 permits high pressure gas to flow from the discharge manifold 24 through the passage 70, the valve 80, the passage 82 and the jet tube 84 within the scrubber vessel 16. The gas flowing through the jet tube 84 sucks the liquid and condensate into the jet tube, from which it is discharged through the motor valve 78 and the passage 86 to the remote liquid storage tank.

Thus it is apparent that there has been provided, in accordance with the invention, methods of and means for low volume wellhead compression of hydrocarbon gas that fully satisfies the objects, aims, and advantages set forth below. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A system for producing fluid which includes gas from a hydrocarbon well, comprising:

(a) An inlet manifold connectable to said well;

(b) a discharge manifold connectable to a gas collection system;

(c) compressor means connected to the inlet manifold and the discharge manifold whereby gas from the well is pressurized and discharged through the discharge manifold;

(d) first switch means for deactivating the compressor means when the pressure in the discharge manifold rises above a first predetermined pressure and for permitting activation of the compressor means when the pressure in the discharge manifold drops below a second predetermined pressure, which is less than or equal to said first predetermined pressure; and (e) second switch means for deactivating the compressor means when the pressure in the inlet manifold drops below a third predetermined pressure and for permitting activation of the compressor means when the pressure in the inlet manifold rises above a fourth predetermined pressure, which is greater than or equal to said third predetermined pressure;

(f) starting means for activating said compressor means when said compressor means is not already activated and when said first and said second switch means both permit activation of said compressor.

2. The system of claim 1 wherein said first and second switch means cooperate in series so that either of said first or said second switch means may independently deactivate said compressor means but so that both said first and second switch means must permit said compressor means to be activated before said compressor means is permitted to be activated.

3. A system for producing fluid which includes gas from a hydrocarbon well, comprising:

(a) an inlet manifold connectable to said well;

(b) a discharge manifold connectable to a gas collection system;

(c) compressor means connected to the inlet manifold and the discharge manifold whereby gas from the well is pressurized and discharged through the discharge manifold, wherein the compressor means comprises a reciprocating compressor comprising a low pressure stage, a high pressure stage, and an interstage cooler connected between the low pressure stage and the high pressure stage, (d) switch means for deactivating the compressor means when the pressure in the discharge manifold rises above a first predetermined pressure and for permitting activation of the compressor means when the pressure in the discharge manifold drops below a second predetermined pressure, which is less than or equal to said first predetermined pressure; and (e) the reciprocating compressor further comprises a crankcase, purging means for introducing the hydrocarbon gas into the crankcase, and vent means for venting the crankcase to the atmosphere.

4. The system of claim 3 wherein the compressor means further comprises:

(a) a pressurized lubricating oil system for supplying lubricating oil to moving parts of said reciprocating compressor;

(b) a sump;

(c) a lubricating oil pump actuated by the operation of said reciprocating compressor for supplying lubricating oil from said sump to said pressurized lubricating oil system;

(d) a lubricating oil storage vessel external said compressor;

(e) first valve means for supply lubricating oil from said storage vessel to said sump so as to prevent the level of the lubricating oil with said sump from dropping below a predetermined level; and (f) second valve means for introducing lubricating oil from said pressurized lubricating oil system to said storage vessel during the operating of said reciprocating compressor.

5. The system of claim 3 further comprising means for introducing lubricating oil at a controlled rate into said gas immediately upstream of said low pressure stage during the operating of said compressor means.

6. A system for producing fluid which includes gas from a hydrocarbon well, comprising:

(a) an inlet manifold connectable to said well;

(b) a discharge manifold connectable to a gas collection system;

(c) compressor means connected to the inlet manifold and the discharge manifold whereby gas from the well is pressurized and discharged through the discharge manifold;

(d) switch means for deactivating the compressor means when the pressure in the discharge manifold rises above a first predetermined pressure and for permitting activation of the compressor means when the pressure in the discharge manifold drops below a second predetermined pressure, which is less than or equal to said first predetermined pressure;

(e) scrubber means connected between said inlet manifold and said compressor means for separating liquid and condensate in said fluid from said gas before said gas passes to said compressor means;

(f) said scrubber means comprises a vessel adapted for storing said liquid and condensate, dump means for moving said liquid and condensate, dump means for moving said liquid and condensate from said vessel, and float means responsive to the volume of said liquid and condensate in said vessel for intermittently actuating and deactuating said dump means.

7. The system of claim 6 wherein said dump means comprises a jet tube passing through said vessel which is actuated by the passage therethrough of pressurized gas from the discharge manifold.

8. The system of claim 6 wherein said scrubber means further comprises high pressure regulator means to prevent the pressure within the vessel from exceeding a third predetermined pressure.

9. A method of compressing substantially low pressure fluid which includes gas from a hydrocarbon well comprising the steps of:

(a) gathering said fluid from the well;

(b) selectively compressing gas of said low pressure fluid to a substantially high pressure gas without objectionable increase in temperature, (c) selectively discharging said substantially high pressure gas to a gas transmission line;

(d) said fluid includes liquid and condensate and further comprising the steps of separating a substantial portion of the liquid and condensate from said substantially low pressure fluid before said gas is selectively compressed, storing said separated liquid and condensate, and selectively dumping said stored separated liquid and condensate when the quantity of said stored separated liquid and condensate exceeds a predetermined amount; and (e) further comprising the step of purging with gas a crankcase of a reciprocating compressor used for the step of selectively compressing said gas and venting said purging gas from said crankcase.

* * * * *